United States Patent [19]

Diamond

[11] Patent Number: 4,857,706

[45] Date of Patent: Aug. 15, 1989

[54] IRONING ACCESSORY

[76] Inventor: Paul J. Diamond, 25617 Cielo Ct., Valencia, Calif. 91355

[21] Appl. No.: 162,209

[22] Filed: Feb. 29, 1988

[51] Int. Cl.[4] ..... D06F 75/38; F24H 3/02; H05B 1/00

[52] U.S. Cl. ..... 219/373; 279/71; 403/350; 403/352; 403/367; 403/328; 219/245

[58] Field of Search ..... 219/373, 366, 367, 368, 219/369, 370, 371, 245; 279/71; 403/350, 351, 352, 328, 367, 105

[56] References Cited

U.S. PATENT DOCUMENTS

| | | | |
|---|---|---|---|
| 1,477,440 | 12/1923 | Grier | 279/71 |
| 4,524,263 | 6/1985 | Yamac | 219/370 |
| 4,636,613 | 1/1987 | de la Morandiere | 219/373 |

FOREIGN PATENT DOCUMENTS

| | | | |
|---|---|---|---|
| 0202561 | 11/1986 | European Pat. Off. | 219/245 |
| 2817734 | 11/1978 | Fed. Rep. of Germany | 279/71 |
| 3605778 | 10/1986 | Fed. Rep. of Germany | 219/245 |

*Primary Examiner*—Teresa J. Walberg
*Attorney, Agent, or Firm*—Roger A. Marrs

[57] ABSTRACT

An ironing accessory is adapted to be releasably carried on the discharge nozzle of a standard hair blow dryer and includes a flat plate having multiple openings discharging hot air from the nozzle. A cylindrical collar carried on the plate insertably receives the nozzle, and resilient grippers are disposed in a radial arrangement on the inside of the collar for releasably attaching with the nozzle. A cam arrangement is carried on the inside surface of a retaining ring and, rotatable therewith, advances the grippers into engagement with the nozzle as a ratchet mechanism retains the grippers in position as the ring is rotated. Resilient pushbuttons disconnect the ratchet mechanism to release the grippers for nozzle removal.

4 Claims, 2 Drawing Sheets

IRONING ACCESSORY

BACKGROUND OF THE INVENTION

1. Field of the Invention

The present invention relates to the field of ironing and pressing implements for garments and more particularly to a novel ironing accessory adapted to be releasably held onto the nozzle of a conventional hair blow dryer so that the warm discharge air can be circulated about the surface of a garment for ironing and pressing purposes intended to remove wrinkles or the like.

2. Brief Description of the Prior Art

In the past, travelers have been unable to iron or freshen their garments during travel unless the garments were sent to a cleaning and pressing shop or unless they had a small and portable iron. Although the portable travel irons are useful for their intended purpose, they are still bulky and are useful for only one purpose and cannot be combined with other personal accessories or implements so that a combination of uses can be attained. Also, most travel irons of the portable type include all sorts of folding and pivoting parts and mechanisms enabling the device to be reduced in size for transport, storage or carrying purposes. Such a necessity greatly increases the cost and complexity not only of design, but for the user of the device. Particularly in those instances where heat is required, electrical voltages differ in many parts of the world so that a plurality of adapters or the device can only be used in a particular geographical locale.

Therefore, a long standing need has existed to provide a novel ironing accessory that may be readily attached to a hot air device, such as a hair blow dryer, whereby the discharge from the dryer can be applied or circulated about the surface of a garment for ironing purposes. Such a device or means should be simple, readily attachable to the dryer, simple to use and convenient to store or carry.

SUMMARY OF THE INVENTION

Accordingly, the above problems and difficulties are obviated by the present invention which provides a novel ironing accessory that is readily attachable to the barrel or discharge nozzle of a conventional hair blow dryer and which includes a body having a plate carried on one side thereof in fixed parallel spaced relationship by means of standoffs and a fixed collar on the other side of the plate adapted to rotatably receive a retaining ring. The collar further includes several resiliently mounted gripping fingers on the inside of the collar while the retaining ring includes sloping cam surfaces that are disposed immediately behind each of the gripper fingers so that upon rotation of the ring, the gripper fingers are advanced into frictional engagement with the barrel or discharge nozzle of the dryer. The collar includes spring biased pushbutton means for releasing a ratchet mechanism employed to retain the ring and collar in fixed position.

The ironing plate is provided with a plurality of openings so that hot discharge air from the nozzle extends between the base and ironing plate and expels through the openings into contact with the garment being ironed.

Therefore, it is among the primary objects of the present invention to provide a novel ironing accessory that may be readily and releasably attached to the barrel or discharge nozzle of a standard hair blow dryer and which includes no moving parts other than the attachment means and release therefor between the accessory and the dryer.

Another object of the present invention is to provide a novel ironing accessory that may be readily carried by travelers and which may be used in combination with another personal accessory such as a hair blow dryer so that the warm air from the dryer can be applied to a garment for ironing purposes.

Still another object of the present invention is to provide an ironing accessory which is inexpensive to manufacture and that may be readily installed or disassembled from a conventional hair blow dryer with simplicity and without the need of hand tools or the like.

Yet another object of the present invention is to provide a novel accessory detachably connectable to the barrel of a blow dryer whereby the blow dryer is neither damaged nor rendered inefficient for its intended purpose and which takes advantage of the warm air discharge from the dryer for application to the surface of garments intended to be ironed.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
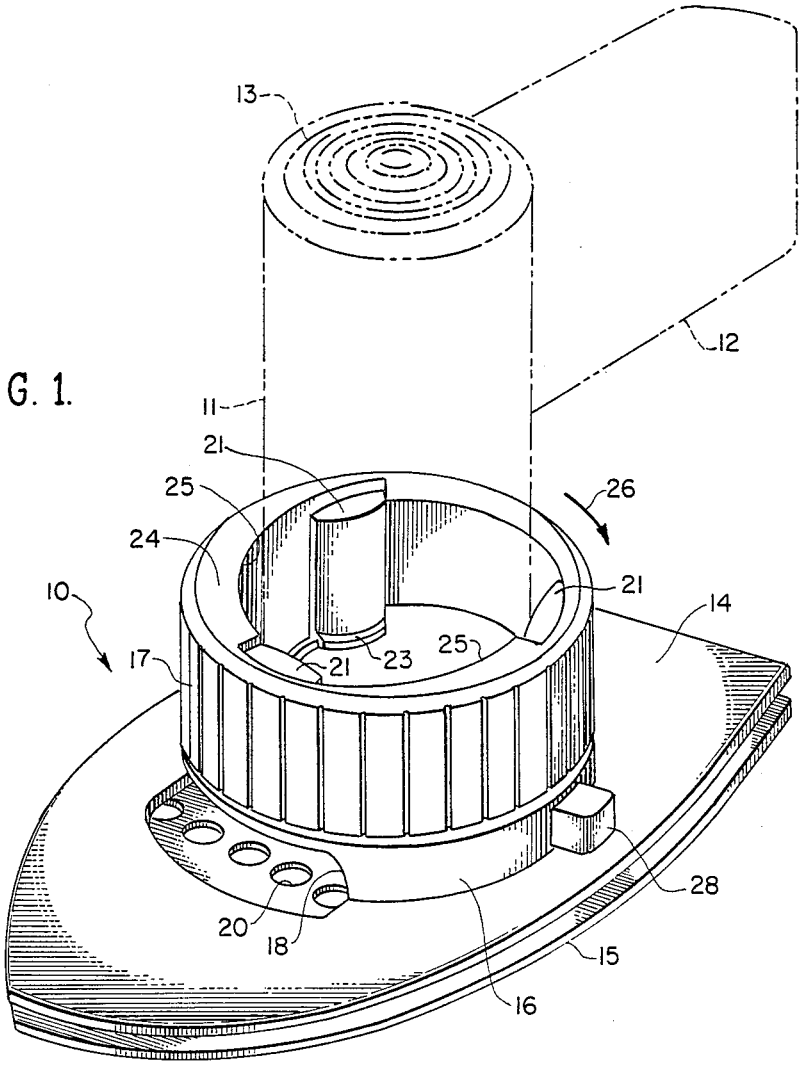
FIG. 1 is a front perspective view showing the novel ironing accessory the present invention.

Referring to FIG. 1, the novel ironing accessory or implement of the present invention is shown in the general direction of arrow 10 wherein the device is removably attached to a barrel or discharge nozzle 11 of a conventional hair dryer. The standard hair dryer includes a handle 12 and an inlet 13 at one end of the barrel or nozzle 11 so that ambient air can be drawn into the heating mechanism of the dryer for discharge through the opposite end of the cylindrical barrel.

The ironing accessory of the present invention includes a base 14 having an ironing plate 15 carried on one side of the base in fixed parallel spaced-apart relationship. The other side of the base 14 is provided with a circular collar 16 on which a retaining ring 17 is rotatably carried on coaxial relationship therewith. The base 14 and the front portion of the collar 16 include coextensive openings represented by numeral 18 through which heated air discharge from the barrel 11 may pass. However, it is to be understood that a major portion of the air discharge will flow between the underside of the base 14 and the plate 15 for expulsion about the peripheral edges thereof and through a multiplicity of openings such as opening 20 shown through the frontal port 18.

Figure 2:
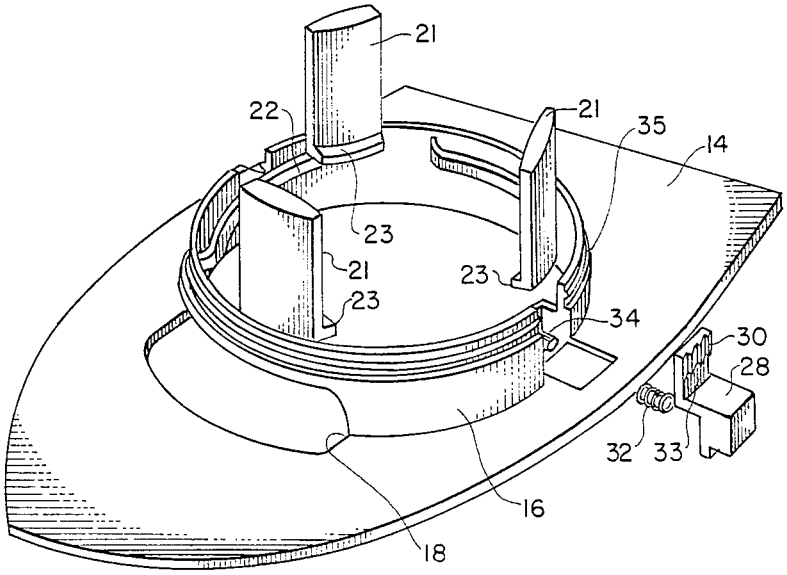
FIG. 2 is a front perspective view of the base employed in the ironing accessory of FIG. 1 with the retaining ring removed.

As shown more clearly in FIGS. 1 and 2, the inside of the collar 16 is provided with several gripper fingers such as finger 21 that are resiliently attached to the inner surface of the collar by means of resilient arms, such as arm 22, attached at one end to the inside of the collar and cantilevered in a curvilinear direction laterally to terminate at its free end with a gripper finger, such as finger 21. Therefore, it can be seen that the various gripper fingers can be moved readily to and from the inner surface or sidewall of the collar 16. Each of the gripper fingers includes a bottom wall or lip 23 serving as a limit stop for arresting further insertion of the barrel 11 into the bore of the collar and ring arrangement. Therefore, introduction of the end of the barrel 11 cannot proceed past its abutting engagement with the walls or ledges 23.

Figure 5:
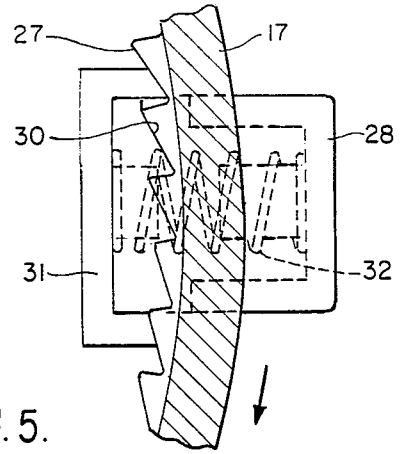
FIGS. 5 and 6 are enlarged fragmentary views, shown in sections, of the spring-biased pushbutton means for releasably holding the ratchet the mechanism between the retaining ring and collar.
Figure 6:
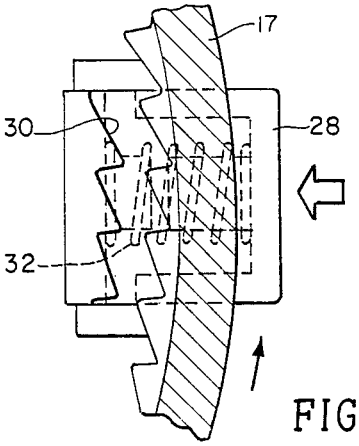

In order to move the gripper fingers away from the wall surface of the collar and into gripping relationship with the outside of barrel 11, the retaining ring 17 includes several tapering cam elements, such as element 24 in FIG. 1. Each element includes a ramp 25 disposed immediately behind each of the gripper fingers 21. Therefore, as the retaining ring 17 is moved in a clockwise direction, as indicated by arrow 26, the ramp 25 will forcibly urge its associated gripper finger inwardly towards the surface of the barrel 11. FIG. 5 illustrates that the inside diameter of the retaining ring 17 includes one-half of a ratchet arrangement, identified by teeth 27, while a pushbutton arrangement 28 composes the other half of a ratchet arrangement by having mating teeth 30 adapted to ratchet with the teeth 27. Therefore, as the retaining ring is rotated, counterclockwise rotation is arrested by engagement of the ratchet teeth with one another to prevent release or outward movement of the gripper fingers 21. The pushbutton 28 is resiliently carried in a housing 31 formed with the fixed collar 16 and a resilient spring 32 completes the ratchet arrangement by permitting the pushbutton to move back and forth as the ring is moved clockwise to accommodate movement of the ratchet teeth over one another. Therefore, as the retaining ring 17 is rotated in a clockwise direction, the ramp surfaces of the cams forcibly urge the associated gripper fingers 21 to engage with the outer surface of the barrel and engagement of the ratchet teeth prevent release since counterclockwise rotation of the retaining ring 17 is prevented. However, when it is desired to release the retaining ring so that counterclockwise movement will be permitted, the pushbutton 28 is pressed inwardly, as shown in FIG. 6, so that teeth 30 are removed from teeth 27 to permit counterclockwise rotation of the ring so as to withdraw the ramp surfaces of the cam elements from their wedged position behind the respective gripper fingers.

Referring now in detail to FIG. 2, it can be seen that the teeth 30 associated with the ratchet mechanism are outwardly facing from one side of a projection 33 carried on the end of pushbutton 28. The spring 32 is of the coil or helical type and is carried on a pin 34 so that one end of the spring bears against the collar 16 while the other end of the spring bears against the inside of pushbutton 28. Therefore, the teeth 30 are biased into engagement with the teeth 27 of the ratchet arrangement. The retaining ring 17 is rotatably engaged with the upper end of the collar 16 by means of a plurality of threads, indicated by numeral 35. Only limited rotation of the ring on the collar is necessary to engage the gripper fingers with the barrel 11. If preferred, a frictional surface can be carried on each of the gripper fingers, such as a rubber-like substance.

Figure 3:
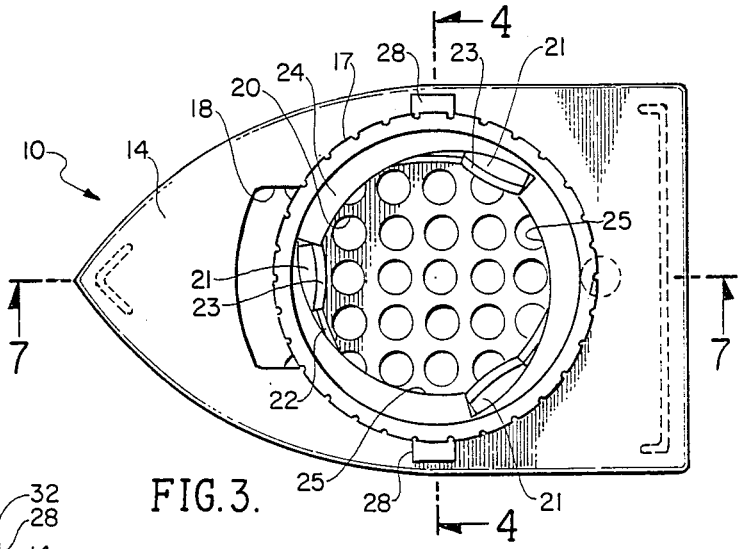
FIG. 3 is a reduced top plan view of the ironing accessory.

In FIG. 3, the coaxial relationship between the ring and the collar is illustrated, as well as the provision for a resiliently biased pushbutton on each side of the device. In the fully open position, as shown in FIG. 3, the inside surfaces of the gripper fingers are generally coextensive with the ramp surfaces of the cam element. The backside of each of the grabber fingers is somewhat curved so as to smoothly ride on the ramp surface as the diameter of the cam element increases during rotation of the ring 17.

Figure 4:
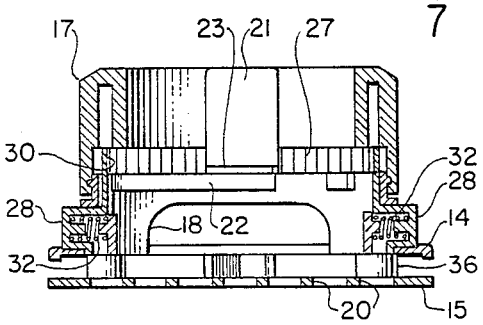
FIG. 4 is a transverse cross-sectional view of the ironing accessory shown in FIG. 3 as taken in the direction of arrows 4—4 thereof.

Referring now in detail to FIG. 4, it can be seen that the ironing plate 15 is carried in fixed spaced relationship with respect to the underside of the base 14 by means of standoffs, such as standoff 36. Also, the gear teeth 27 are illustrated which are engaged therewith by teeth 30 on each of the respective pushbuttons in ratchet relationship.

Figure 7:
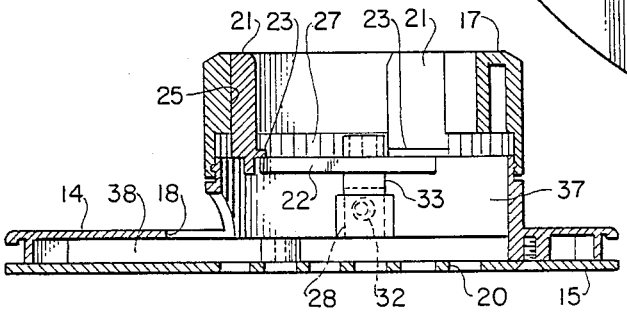
FIG. 7 is a longitudinal cross-sectional view of the ironing accessory shown in FIG. 3 taken in the direction of arrows 7—7 thereof.

FIG. 7 further illustrates the ratchet teeth 27 engaged by the teeth 30 of the pushbutton. Also, it can be seen that the flow of air from the discharge of the hair blow dryer will be into a central cavity broadly illustrated by numeral 37, and then exiting through the front port 18, through the peripheral sides of opening 38 and through the respective openings 20 in plate 15.

Figure 8:
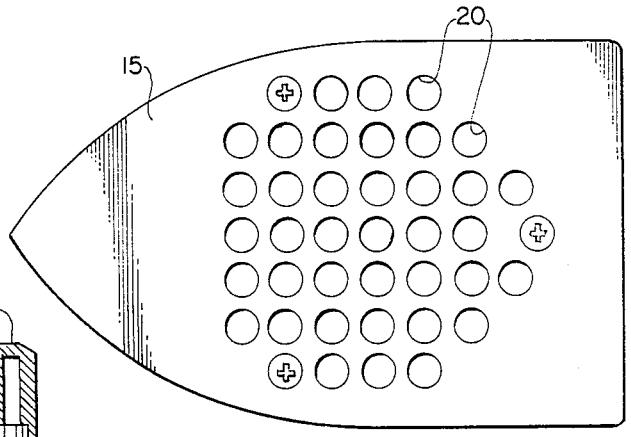
FIG. 8 is a bottom plan view of the ironing apparatus illustrating the multiple openings for expelling warm air therethrough.

FIG. 8 more clearly shows the multiple openings in plate 15 and the screw fasteners which extend through the plate into the standoffs carried on the underside of base 14.

Therefore, in view of the foregoing, it can be seen that the inventive ironing accessory of the present invention may be readily attached and detached from the external surface of the discharge end of the barrel 11 carried on the hair dryer. The warm air is conducted through the accessory or implement and either into direct contact with the garment through the plurality of openings 20 or in close proximity thereto via port 18 and the sides of the device. The cam arrangement permits ready securement of the gripper fingers with the barrel and the pushbutton release disconnects the ratchet mechanism so that the ring 17 can be moved counterclockwise to release the gripper fingers from contact with the barrel. No pivoting or moving parts are required to reduce the size of the ironing implement since handles and/or electrical connectors are unnecessary. The device is used in combination with the hair dryer which provides the handle and the source of heat necessary for wrinkle removal from the garment.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In an ironing accessory for use in combination with a hot air discharge nozzle of a standard hand-held hair blow dryer, the combination which comprises:

an elongated base having a top surface and a bottom surface;

an ironing plate secured to said base bottom surface in fixed spaced-apart relationship to define a spatial cavity therebetween for exhaust of hot hair from a nozzle about a periphery of said base and plate;

a circular collar carried on said base top surface resiliently supporting gripper means on its inner surface for radial movement of said gripper means into and out of engagement with said nozzle;

means rotatably carried on said collar for moving said gripper means in said radial movement;

release means operably disposed on said collar for releasing said gripper means from engagement with said nozzle;

said gripper means includes a plurality of fingers disposed with said collar and mounted thereon by a resilient cantilevered arm;

said rotatable means includes a retaining ring having cam means disposed immediately behind each of said gripper fingers so as to advance said gripper fingers against said nozzle in response to rotation of said retaining ring;

ratchet mechanism cooperatively disposed between said collar and said retaining ring to ensure movement of said retaining ring in a direction to close said gripper fingers about said nozzle; and a spring biased release means carried on said base for disconnecting said ratchet mechanism to permit disengagement of said gripper means with said nozzle.

2. The invention as defined in claim 1 including:

said ironing plate having a plurality of hot air exhaust openings disposed in close proximity to said collar.

3. The invention as defined in claim 2 wherein:

said gripper fingers are coaxially disposed with respect to said collar and include stop means terminating insertion of said nozzle into said collar.

4. The invention as defined in claim 3 wherein:

said cam means includes a laterally sloping ramp disposed behind each of said gripper fingers and wherein a backside of each gripper finger is a cam follower slidably engageable with said sloping ramp of said cam means in response to said retaining ring rotation.

* * * * *